US005299334A

United States Patent [19]

Gonzalez

[11] Patent Number: 5,299,334

[45] Date of Patent: Apr. 5, 1994

[54] HYDRAULIC OSCILLATING TREATMENT TABLE AND METHOD

[75] Inventor: Felipe J. Gonzalez, San Antonio, Tex.

[73] Assignee: Kinetic Concepts, Inc., San Antonio, Tex.

[21] Appl. No.: 824,816

[22] Filed: Jan. 21, 1992

[51] Int. Cl.[5] ..... A61G 7/06

[52] U.S. Cl. ..... 5/607; 5/610; 5/611; 5/622; 5/623; 5/624

[58] Field of Search ..... 5/601, 607–611, 5/621–624

[56] References Cited

U.S. PATENT DOCUMENTS

| | | | |
|---|---|---|---|
| 2,701,744 | 2/1955 | Koerner et al. | 5/610 X |
| 3,434,165 | 3/1969 | Keane | 5/608 |
| 4,557,471 | 12/1985 | Pazzini | 5/610 X |
| 4,654,903 | 4/1987 | Chubb et al. | 5/607 |
| 4,672,952 | 6/1987 | Vrzalik | 5/621 X |
| 4,924,537 | 5/1990 | Alsip et al. | 5/608 |
| 4,947,496 | 8/1990 | Connolly | 5/622 X |
| 4,985,946 | 1/1991 | Foster et al. | 5/611 X |
| 5,131,103 | 7/1992 | Thomas et al. | 5/601 |

FOREIGN PATENT DOCUMENTS

| | | | |
|---|---|---|---|
| 786125 | 6/1935 | France | 5/608 |

*Primary Examiner*—Michael F. Trettel

[57] ABSTRACT

A bed for maintaining a patient body with the head in any desired angular position relative to the feet, and for continuously rotating the patient so that one side of the patient is lower than the other, comprises a floor engaging base on which is mounted a cantilever frame elevatable to any desired angular position relative to the base. A bed table subframe is pivotally mounted to the free end of the cantilever frame and adjustable in a vertical plane to accomplish either Trendelenburg and Reverse Trendelenburg therapy on the patient. Pivot connections are provided between the patient support table and the table subframe for effecting the selective movement of the support table about one or the other of two horizontally spaced, longitudinally extending axes. Patient restraining elements are mounted to the sides of the patient supporting table to prevent movement of the patient in any of the various positions to which the support table may be shifted.

23 Claims, 13 Drawing Sheets

HYDRAULIC OSCILLATING TREATMENT TABLE AND METHOD

BACKGROUND OF THE INVENTION

1. Field of the Invention

The present invention relates to oscillating treatment tables (also known as laterally rotating treatment tables) of the type generally shown in U.S. Pat. No. 3,434,165, which issued to Frances Xavier Keane on Mar. 25, 1969. More particularly, though, the present invention relates to hydraulically-powered oscillating treatment tables.

2. Background References

It is well known in the art to provide a patient support that is adapted for controlled oscillatory movement, principally so that immobile patients may be gently turned from side to side automatically—without requiring the manual intervention of an attendant. Such oscillating patient supports are believed to be beneficial for a variety of medical indications related to patient immobility, including (without limitation) atelectasis, decubitis, urinary tract obstruction, and pulmonary complications.

Examples of beds having oscillatory patient support platforms are shown in U.S. Pat. Nos. 3,343,165 issued to F. X. Keane on Mar. 25, 1969 and U.S. Pat. No. 4,175,550 issued to James R. Leininger et al. on Nov. 27, 1979. For any and all purposes, each of those patents are incorporated herein by this specific reference thereto. The support beds of the above patents provide lateral rotation treatment to substantially lessen if not eliminate the problems and complications for an immobile patient.

It is also known to provide a cantileved frame utilizing hydraulic power for raising and lowering the frame, although such frames have deficiencies.

It is an object of this invention to provide a new and improved oscillating treatment table. It is also desirable that the bed be safe, efficient, reliable, relatively simple, and easily manufactured and operated.

Many other objects of this invention will be evident to those of ordinary skill in the art, either in view of the prior art or in view of the summary, descriptions and claims which follow.

SUMMARY OF THE INVENTION

This invention provides a simplified, yet very reliable operating mechanism(s) for therapeutic beds which overcomes all of the aforementioned and many other disadvantages of prior art constructions.

A customary, caster-supported, elongated base frame is provided on which is mounted a motor driven fluid pump for generating fluid pressures to supply various operating cylinders incorporated in the bed structure. A cantilever frame is pivoted at its one end to one end of the base frame for movement in a vertical plane and is raised and lowered in such vertical plane by a fluid pressure actuated cylinder. On top of the cantilever frame, an elongated subframe is pivotally mounted about a transverse horizontal axis, but also incorporates two fluid actuated cylinders for controlling the vertical angle between the subframe and the cantilever frame. Those latter two cylinders permit the subframe to be tipped to assume any selected angle, such as the horizontal or offsets from the horizontal, sufficient to accomplish either Trendelenburg and Reverse Trendelenburg therapy for the patient.

A patient supporting table mounted on the subframe is of generally rectangular configuration being normally wider and longer than the width and height of the anticipated patients. The patient support table is defined by a perimetrical metallic frame which mounts a top surface formed of a radio translucent material to facilitate the taking of X-rays of the patient. On each longitudinal side of the perimetrical frame, a longitudinally extending support rod is fixedly mounted in the perimetrical frame. The support rods provide two transversely spaced, horizontal pivot axes about which the support table may be tilted to provide oscillatory therapy for the patient.

The support table is connected to the subframe solely by a pair of fluid actuated cylinders having their upper ends respectively pivotally journaled on the support rods and their lower ends pivotally mounted on opposite longitudinal sides of the subframe, thus disposing the cylinders in a generally X-shaped configuration.

Each longitudinal side of the subframe is provided with a row of longitudinally aligned, open top bearing recesses or sockets into which the support rods may be respectively inserted. When both cylinders are retracted, the support rods respectively enter the two longitudinal rows of the upwardly open sockets and are supported thereby, thus providing a stable support for the patient supporting table.

In this collapsed or retracted position of the fluid actuated cylinders, a latch pivotally provided on one end of each of the cylinders is engaged with an abutment formed on the adjacent portion of the subframe so as to prevent any concurrent upward movement of the support rods out of the sockets. At the same time, the configuration of such latches permits either one of the cylinders to be independently activated and to thus move one of the support rods upwardly to pivot the patient support table about the other support rod.

Thus the support table may be selectively pivoted from a horizontal position, wherein both support rods are respectively engaged in the two longitudinal rows of sockets, to a pivoted position in a vertical plane about the axis of one support rod, or to a pivoted position in a vertical plane in the opposite direction about the axis of the other support rod, thus providing a tilting movement back and forth between two oppositely inclined positions. As is well known, such tilting movement is very desirable for the prevention of pneumonia and other disorders in a patient who is required to be immobile for extended periods of time.

To prevent the inadvertent removal of the particular support rod which functions as the pivot from the accidentally be removed from the cooperating sockets, a locking bar is mounted on the subframe for transverse reciprocable movements between one position wherein the locking bar overlies a portion of the support rod about which the pivotal movement is being produced, a second position wherein the locking bar is transversely shifted to overlie a portion of the other support rod when the shifting movement occurs in the opposite direction, and an intermediate position wherein the locking bar is centered in order to prevent both support bars to be removed from their respective longitudinal rows of sockets at the same time.

This invention further provides unique attachments for the patient support table to restrain substantially all of the body portions of the patient in a fixed immobile position regardless of the tilting or tipping of the table about the axes previously described. This is particularly desirable for patients in traction. Thus, a pair of inner leg restraint pads and outer leg restraint pads are respectively mounted on a frame element having upwardly projecting pins to secure the pads in position. Such frame element also provides a mounting for two foot support pads which are respectively disposed between the parallel inner and outer leg support pads. Means are provided for adjusting the longitudinal positions of the inner and outer leg supports and the foot supports to accommodate the size of the patient.

Immediately above the leg restraints, a pair of transversely oppositely disposed thoracic restraining pads are mounted on a frame structure. That frame structure is not only laterally adjustable to move the pads toward or away from each other to accommodate the thoracic portions of the patient but, additionally, the entire thoracic pad frame structure is pivotally mounted on a longitudinal axis parallel to the outer longitudinal edge of the perimetrical frame. That pivotal mounting permits the thoracic support pads to be moved from an upstanding position relative to the support table to a depending position located below the support table, thus facilitating access to the patient. The entire thoracic support can be removed from the support table to enable movement of the patient onto or off of the patient support table.

The thoracic pad frame also includes means for mounting outer arm restraints and an upstanding pin for mounting the top end of the outer leg restraints.

A pair of upstanding support posts are removably attached to the perimetrical frame adjacent the head portion of the patient support table. Respectively mounted on these upstanding support posts are a pair of padded shoulder restraints which are adjustable to accommodate the size of the patient. In addition, the upstanding supports are utilized to mount head engaging pads which are vertically, laterally and longitudinally adjustable to accommodate not only the overall size of the patient but also the particular size of the patient's head.

It sometimes happens that head, neck or chest surgery is required for a patient confined to the therapeutic bed. The normal width of the therapeutic bed would require excessive leaning or bending of the surgeon to accomplish the required surgery. To facilitate such surgery, this invention provides longitudinally extending recesses formed in both sides of the head portion of the perimetrical frame of the patient support table within which are mounted slidable rails for supporting a radio translucent auxiliary headplate and foam pack which provide a narrow head support. This narrow head support permits the surgeon to get closer to the patient's head, neck or chest to avoid such excessive leaning or bending of the surgeon.

Patients confined to therapeutic beds of the type embodying this invention for extended periods of time require removal of body fluids. To accommodate this need, a pair of openings are provided in the top surface of the patient support table on both sides of the rectal area of the patient. A radio translucent cover (or "hatch"), which is flush with the upper surface of the patient support table, is provided for each opening. The hatches define openings for tubing running from the patient to drainage collecting bags or the like.

Particularly for head injured patients where a swollen head creates excessive intracranial pressures (I.C.P.), it may be required to reduce and control such I.C.P., irrespective of the position of the patient or the fact that the patient's body may be pivoting from side to side. For this purpose, the head end of the perimetrical frame of the patient support table is provided with a projecting bracket which defines a vertical bore within which an upstanding rod is adjustably mounted. Such rod is provided with a horizontal pivot on its upper end portions. Such pivot in turn mounts a pendulum type bag supporting rod having a pivot bearing in its medial portion, a weight on its lower end, and a bag holder on its upper end. Thus, as the patient support table is tilted in either direction about a horizontal longitudinal axis, the weight and the pendulum action of the bag holder maintains a substantially constant vertical distance between the bag and the patient's head, thus assuring uniform pressure.

Further advantages of the therapeutic bed embodying this invention will be readily apparent to those skilled in the art from the following-detailed description, taken in conjunction with the annexed sheets of drawings, on which is shown a preferred embodiment of the invention.

DESCRIPTION OF PREFERRED EMBODIMENT

Figure 1:
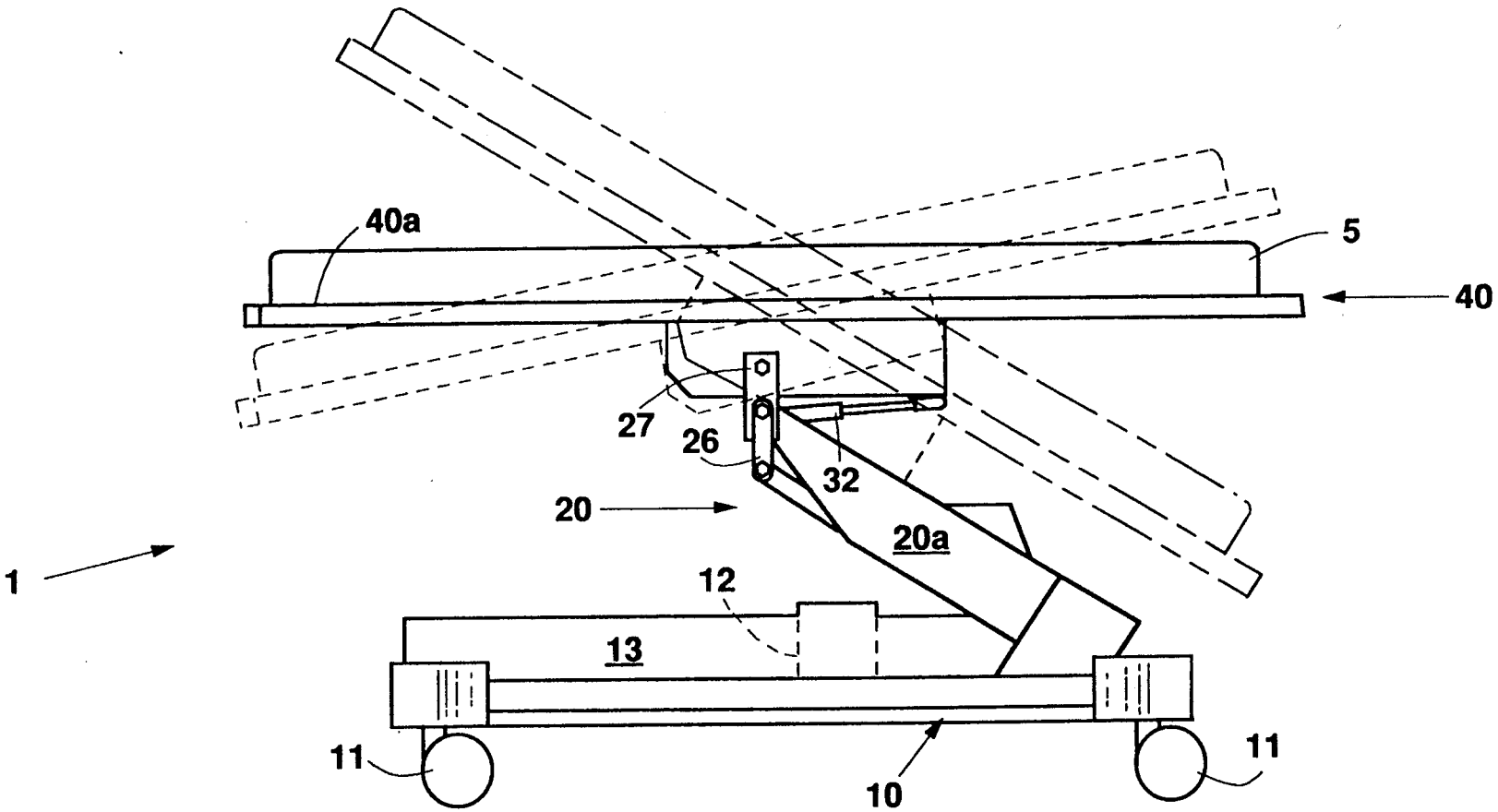
FIG. 1 is a side elevational view of a therapeutic bed embodying this invention, without the patient restraints attached thereto.
Figure 2:
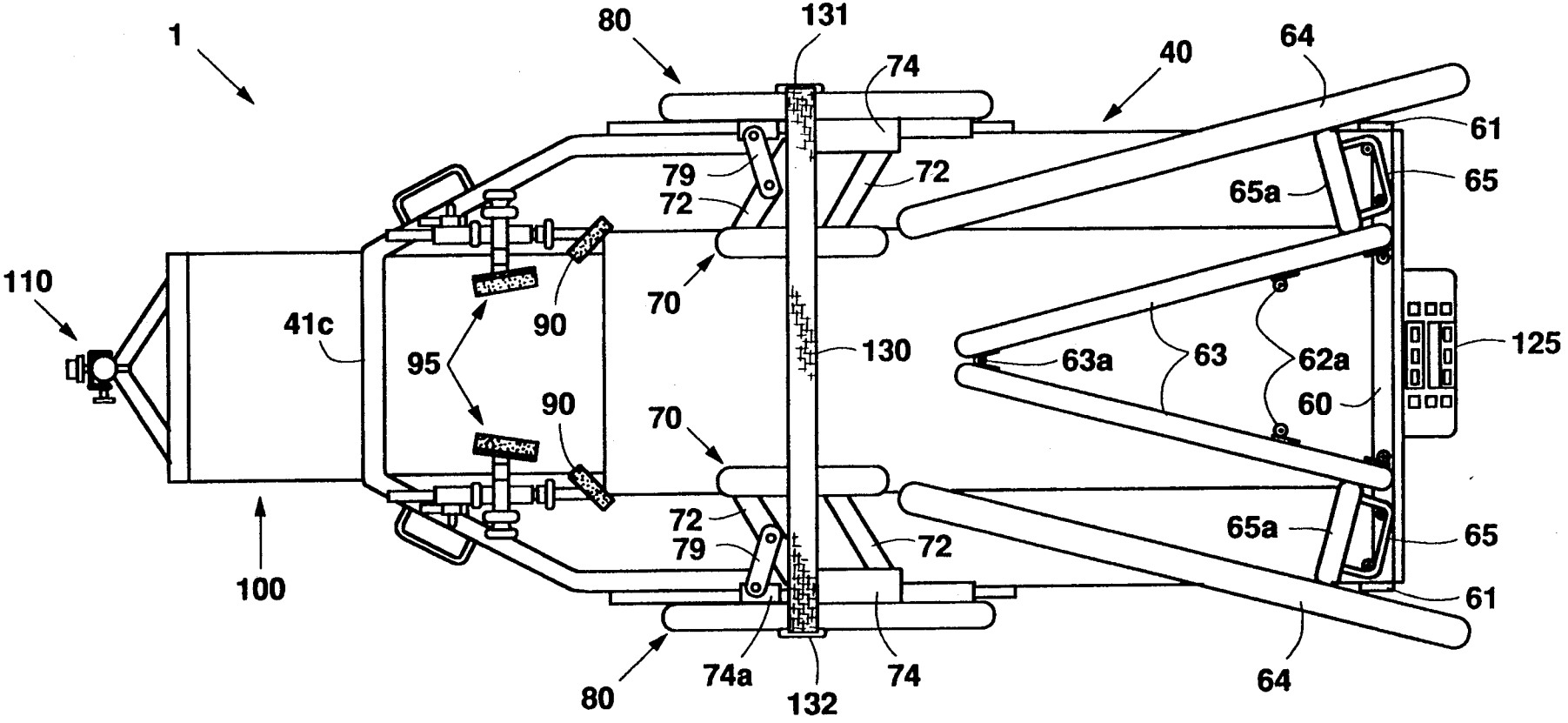
FIG. 2 is a plan view of FIG. 1, but also showing the patient restraining pads and an auxiliary head support.
Figure 3:
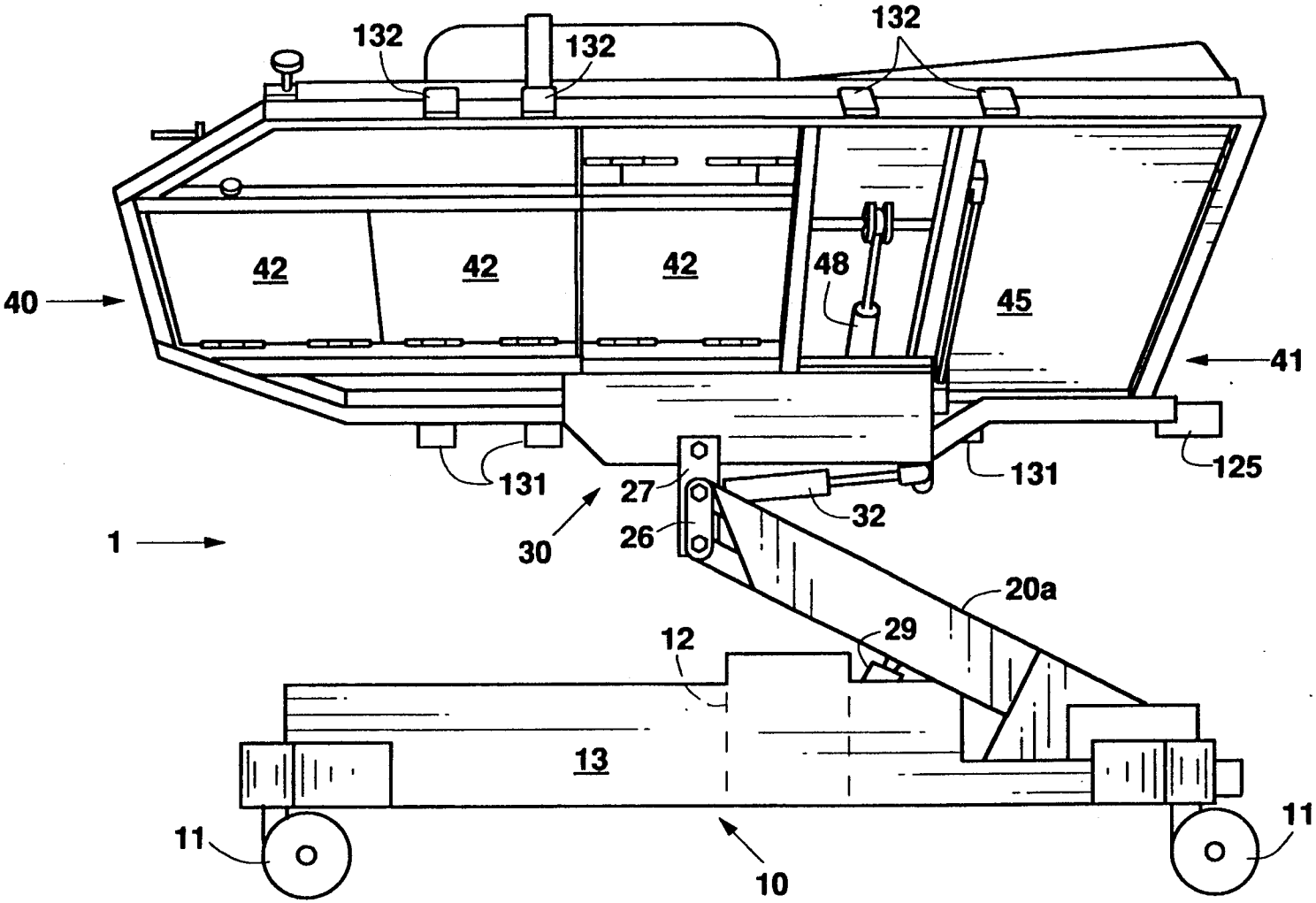
FIG. 3 is a side elevational view of FIG. 2, but with the bed tilted to an extreme position about a selected longitudinal, horizontal axis.

Referring to FIGS. 1-3, there is shown a therapeutic bed 1 constructed according to the teachings of the present invention. The bed 1 is a presently-preferred embodiment of the invention, primarily indicated for treatment of immobile patients, especially immobile patients having cervical or cranial injury. The bed 1 comprises a generally rectangular base frame 10. The base frame has a plurality of depending casters 11 for resting on the floor, which are conventionally journaled adjacent the four corners of base frame 10 for rotational movement about both a horizontal and a vertical axis. On the upper portions of the base frame 10, there is mounted a hydraulic pump 12 and other conventional apparatus (not shown) associated with the control of the various hydraulic cylinders incorporated in the bed 1. As will be evident further herein, all raising and lowering and all rotating motions of the bed frame 40 are hydraulically powered via various hydraulic cylinders, which minimizes the amount of electrical current in the proximity of the patient. In addition, all cylinders are supplied by the same pump 12; this simplifies the power system for the bed 1 and enables other design efficiencies and synergies. For purposes of this description, the hydraulic "cylinders" are referred to as such, although they might best be referred to as "cylinder and piston assemblies". The pump 12 is driven by a conventional electric motor and the controls are entirely conventional and hence do not require detailed description. A U-shaped bracket 14 (FIG. 4) having laterally spaced, upstanding arms is rigidly secured to one end of base frame 10. A cover housing 13 is provided over the top portion of the base frame 10.

Figure 4:
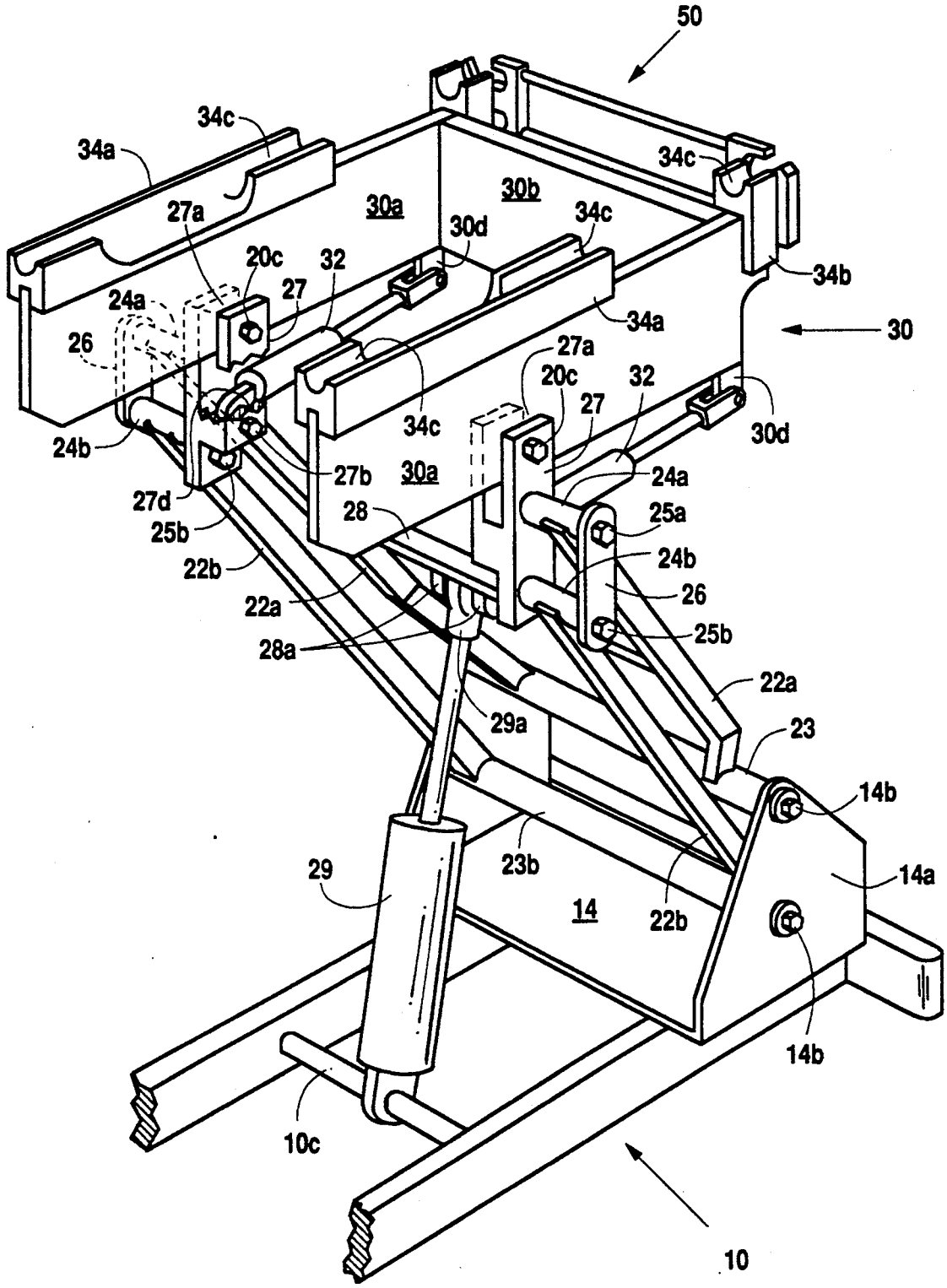
FIG. 4 is a perspective view of the elevating and tipping mechanism for the bed of FIG. 1.

A cantilever frame assemblage 20 is normally enclosed within a cover 20*a* which is removed in FIG. 4 in order to show the operating elements of the cantilever frame assembly 20. Two laterally spaced pairs of generally parallel links 22*a* and 22*b* are respectively welded at their lower ends to opposite ends of transverse rods 23*a* and 23*b*. Rods 23*a* and 23*b* are pivotally mounted on the upstanding arms 14*a* of the U-shaped bracket 14 by pivot bolts 14*b*. Each pair of parallel arms 22*a* and 22*b* are respectively welded at their upper ends to a pair of sleeves 24*a* and 24*b*. The two pairs of sleeves 24*a* and 24*b* are in turn secured to upstanding brackets 27 by bolts 25*a* and 25*b*. Bolts 25*a* and 25*b* which pass through a spacer link 26, through sleeves 24*a* and 24*b*, and respectively threadably engage upstanding brackets 27.

A transverse bar 28 is rigidly secured between the two links 22*a* and supports depending brackets 28*a* to which the piston end 29*a* of a cylinder 29 is pivotally connected. The other end of cylinder 29 is totally connected to a transverse bar 10*c* provided in the base frame 10. Thus, as the cylinder 29 is supplied with pressured fluid, the brackets 27 move upwardly relative to the base frame 10 along an arcuate path.

The brackets 27 are provided with upwardly opening slots 27*a* which respectively receive the longitudinal side plates 30*a* of a rectangular subframe 30. Transverse end plates 30*b* (only one being shown in FIG. 4) are welded at opposite ends thereof to the longitudinal side plates 30*a* to complete the rectangular subframe 30. Although only one end plate 30*b* is shown in FIG. 4, preferably a second end plate is also welded between the opposite side plates 30*a*, substantially parallel to the end plate 30*b* shown but spaced therefrom. A pair of pivot bolts 20*c* respectively traverse the slots 27*a* and the side plates 30*a* to effect a pivotal mounting of the subframe 30 relative to the slotted brackets 27. A pair of cylinders 32 each have one end respectively secured to depending lugs 30*d* respectively provided on the longitudinal side frames 30*a* of subframe 30. The other ends of cylinders 32 are respectively pivotally connected in rearwardly open recesses 27*d* provided in brackets 27 by pivot bolts 27*b*. Thus, extension of cylinders 32 will effect a tipping movement of the subframe 30 in a vertical plane about the axis of the pivot mounting bolts 20*c*. Such tipping movement is independent of the vertical position of the subframe 30 produced by actuation of the cylinder 29 to raise and lower cantilever frame 20.

Along each of the top edges of the longitudinal sides 30*a* of the subframe 30 are respectively secured a pair of elongated bearing elements 34*a* which respectively define longitudinally spaced, upwardly open, semicylindrical bearing recesses or sockets 34*c* for a purpose to be hereinafter described. Additionally, a short bearing element 34*b* is secured to each end of the longitudinal sides 30*a* and defines another bearing recess 34*c*. A transverse safety latch structure 50 is mounted on the longitudinal sides 30*a*, as will be later described.

Figure 5:
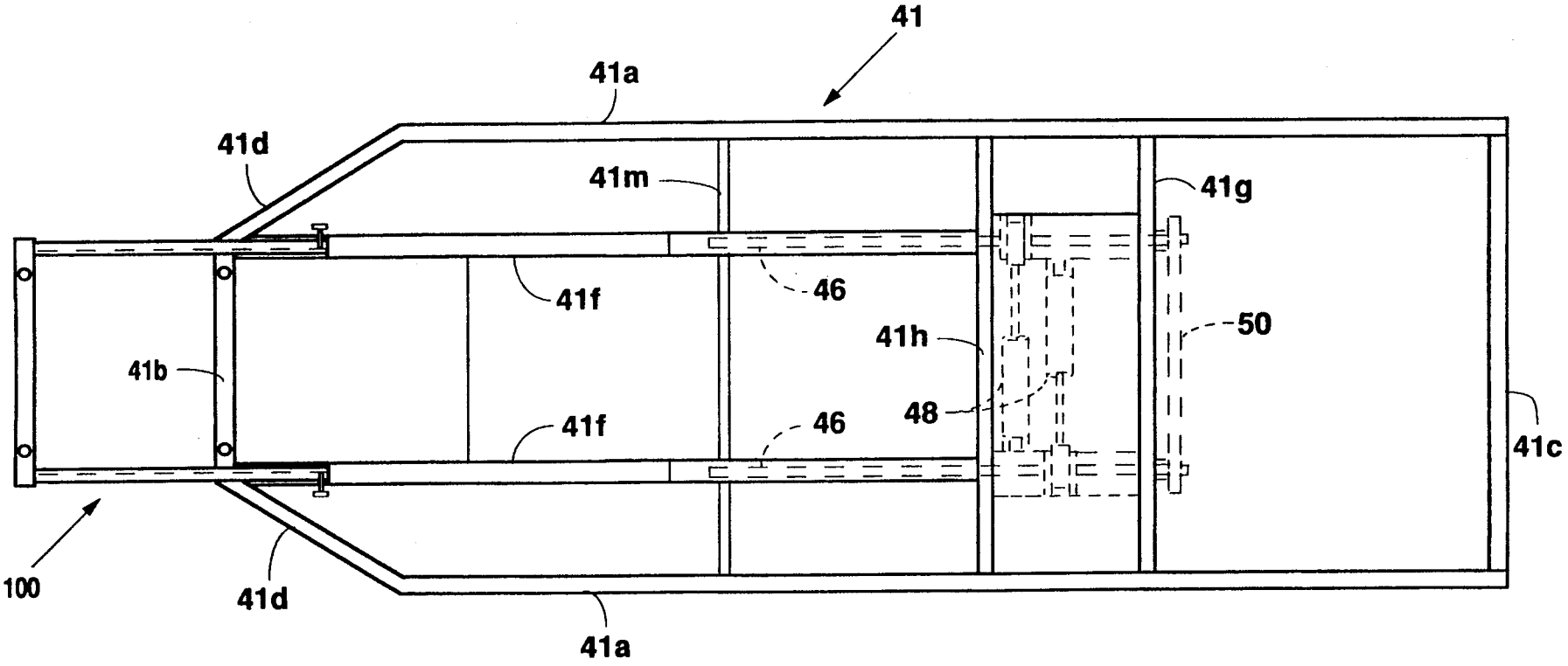
FIG. 5 is a plan view of the support table frame with the patient restraints and phenolic radiolucent hatches removed.
Figure 5A:
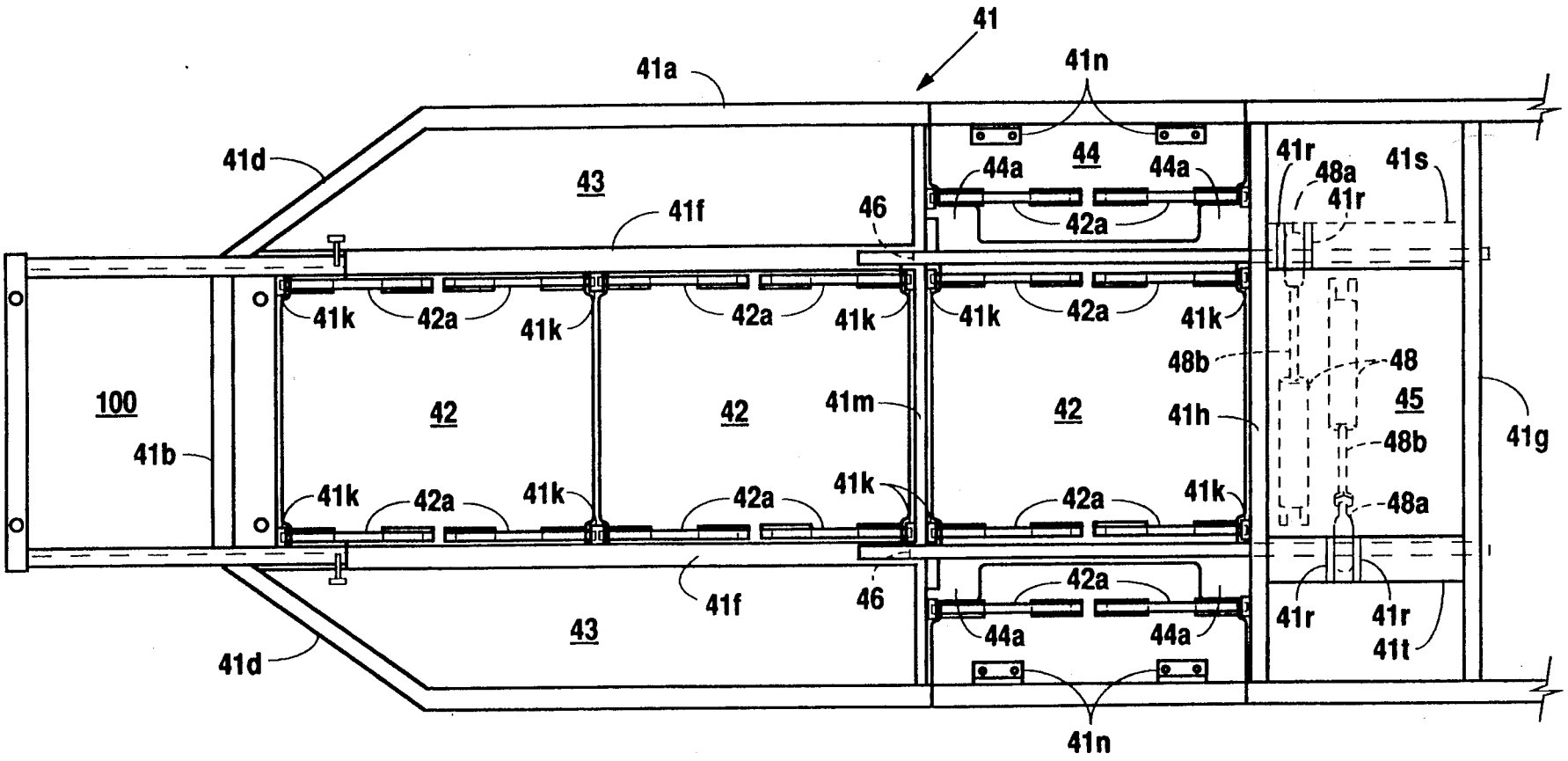
FIG. 5A is an enlarged scale, partial view of the patient support table frame with the rigid plastic hatches applied to the top of the frame to provide a table surface for supporting a mattress.

A patient support table 40 is provided having a generally rectangular, perimetrical frame structure 41 best shown in FIGS. 5 and 5A. The perimetrical frame includes longitudinal metallic frame elements 41*a* and 41*f*, and transverse metallic frame elements 41*b* and 41*c*. Transverse element 41*b* is located at the head end of the patient support table 40 which is tapered as indicated by the angular outer frame elements 41*d*. Transverse frame element 41*c* is located at the foot end of the bed and two additional transverse frame elements 41*g* and 41*h* are spaced above end frame element 41*c*. Laterally spaced longitudinal frame elements 41*f* are provided between end element 41*b* and transverse element 41*h* to make the frame rigid and to provide mounting elements for radioluscent rigid plastic panels 42 (FIG. 5A). Panels 42 are conventionally secured in place by spring pressed pins 42*a* engaging brackets 41*k* provided on longitudinal frame elements 41*f*. Thus, the central portions of the bed frame 41 are not traversed by any metallic objects. X-ray or other radiation studies of the body of the patient, hence, will not be affected by the perimetrical metallic frame structure 41.

The spaces between the left portions of perimetrical frame elements 41*d*, 41*a* and 41*f* land a thin transverse frame 41*m* are respectively covered with fixedly secured panels 43 of a rigid plastic material. The spaces between frame elements 41*a*, 41*h*, 41*f* and the thin transverse frame 41*m* are covered by rigid plastic access plates 44 which are hinged to brackets 41*n* secured to outer frame elements 41*a* and secured in closed position by spring pressed pins 42*a*. Beneath each access plate 44, open space is available, possibly for mounting collecting bags (not shown) for body wastes on hooks. Access plates 44 are provided with cutouts 44*a* to permit tubes (not shown) connected to the patient to be connected to the collecting bags.

Lastly, a rigid plastic plate 45 is secured across the rectangular space bounded by transverse frame elements 41*c* and 41*h*, and the right hand end portions of longitudinal frame elements 41*a*. Thus an essentially smooth, horizontal top surface 40*a* is provided on table 40 on which a patient cushioning mattress 5 may be laid.

Figure 6A:
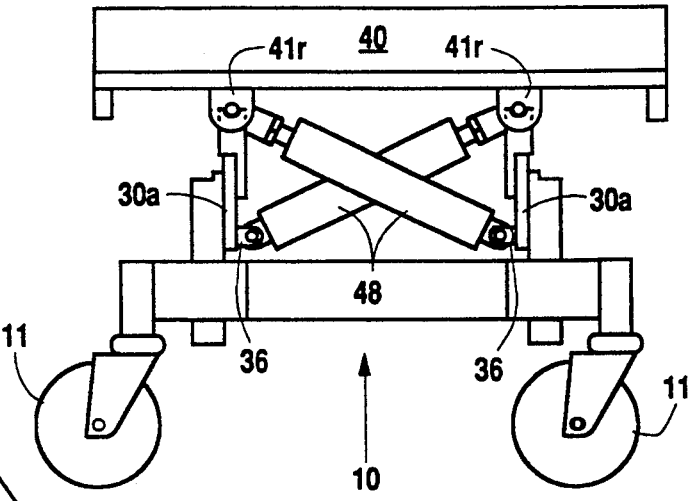
FIG. 6A is a schematic view, illustrating the positions of the bed tilt cylinders when the bed is in a horizontal position.
Figure 6B:
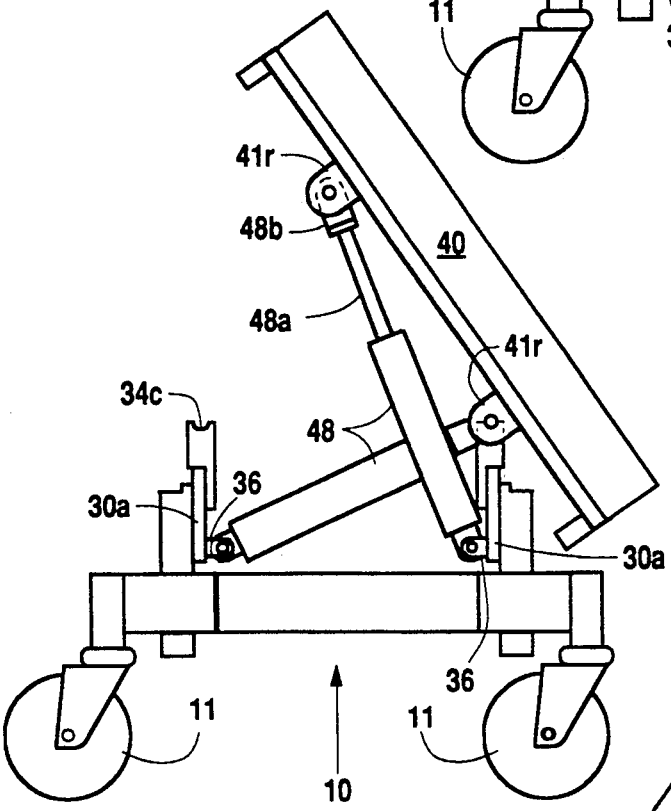
FIG. 6B is schematic view, similar to FIG. 6A, illustrating the positions of the tilting cylinders when the bed is tilted to an extreme clockwise position about a first longitudinal axis.
Figure 6C:
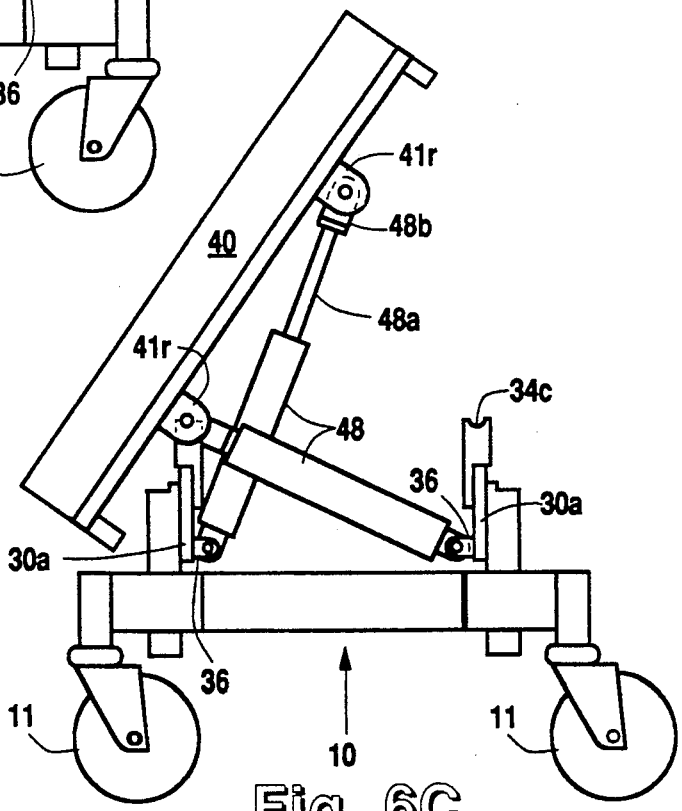
FIG. 6C is a schematic view, similar to FIG. 6A, illustrating the positions of the tilting cylinders when the bed is tilted to an extreme counterclockwise position about a second longitudinal axis, transversely spaced from the first axis.

Referring to FIG. 5 and the schematic views of FIGS. 6*a*, 6*b* and 6*c*, the mounting and positioning of the bed table 40 on subframe 30 can be more clearly observed. A pair of longitudinally extending rods 46 are rigidly mounted in transversely spaced relationship to the underside of the bed frame 41. Such rods are preferably located in general alignment with the right hand end of inner longitudinal frame elements 41*f* and are supported by intermediate transverse frames 41*g*, 41*h*, thin frame 41*m*, and brackets 41*r* mounted on longitudinal plates 41*s* and 41*t* which are rigidly secured between transverse frame elements 41*g* and 41*h*.

Rods 46 perform a dual function which is best illustrated in the schematic views of FIGS. 6A, 6B and 6C, and FIG. 4. When the table 40 is in a horizontal level position, separated portions of the rods 46 enter into the open top bearing recesses 34*c* provided in the bearing brackets 34*a* and 34*b*. Another portion of each of the rods 46 acts as a pivotal mounting for one end 48*b* of a pair of tilting cylinders 48. The other end of each tilting cylinder 48 is pivotally secured to a bearing bracket 36 mounted on the opposed longitudinal wall 30*a* of subframe 30. In the horizontal position, both tilting cylinders 48 are in their fully retracted positions, as shown in FIG. 6A.

In FIG. 6B, one of the cylinders 48 is pressurized to extend the piston rod 48*a* thereof and thus effect a pivoting of the support table 40 about the other pivot rod 46. Conversely, when the pressurization of the two cylinders is reversed, the support table 40 is consequently shifted to an oppositely inclined position as shown in FIG. 6C. In this position, the other support rod 46 functions as the pivot for the tilting movement of the patient support frame 40 and the tilting force is applied to the other support rod by extension of the other cylinder 48, removing the respective support rod 46 from the pivot bracket recesses 34*c*.

Through the application of conventional hydraulic and electrical controls, the cylinders 48 are preferrably programmed to effect a gentle tilting movement of the bed frame 40 from a tilted position toward the right side of the bed, as shown in FIG. 6B, to a tilted position toward the left side of the bed, as shown in FIG. 6C. Preferably, such movement is then repeatably reversed to achieve continual lateral rotation for a patient supported on bed frame 40. Such gradual rotation of an immobilized patient is very desirable, as is discussed elsewhere herein.

It should also be noted that when the actuating cylinders 32 for controlling the angular position of the subframe 30 relative to the cantilever frame assembly 20 are actuated, the table is tipped about a horizontal transverse axis between the solid line position illustrated in FIG. 1 to either of the positions indicated by dotted lines in FIG. 1. Thus, the patient may be subjected to either Trendelenburg or Reverse Trendelenburg therapy. At the same time, the patient may be continuously tilted successively about the two longitudinal axes. It should be particularly noted that the tilting movements of the patient support table about a longitudinal axis is actually accomplished about two alternate axes. The alternate axes are parallel, transversely-spaced longitudinal axes defined by the upwardly-open bearing recesses 34*c*. The alternate axes are also both transversely displaced equidistant from the longitudinal axis of the bed 1.

Figure 4A:
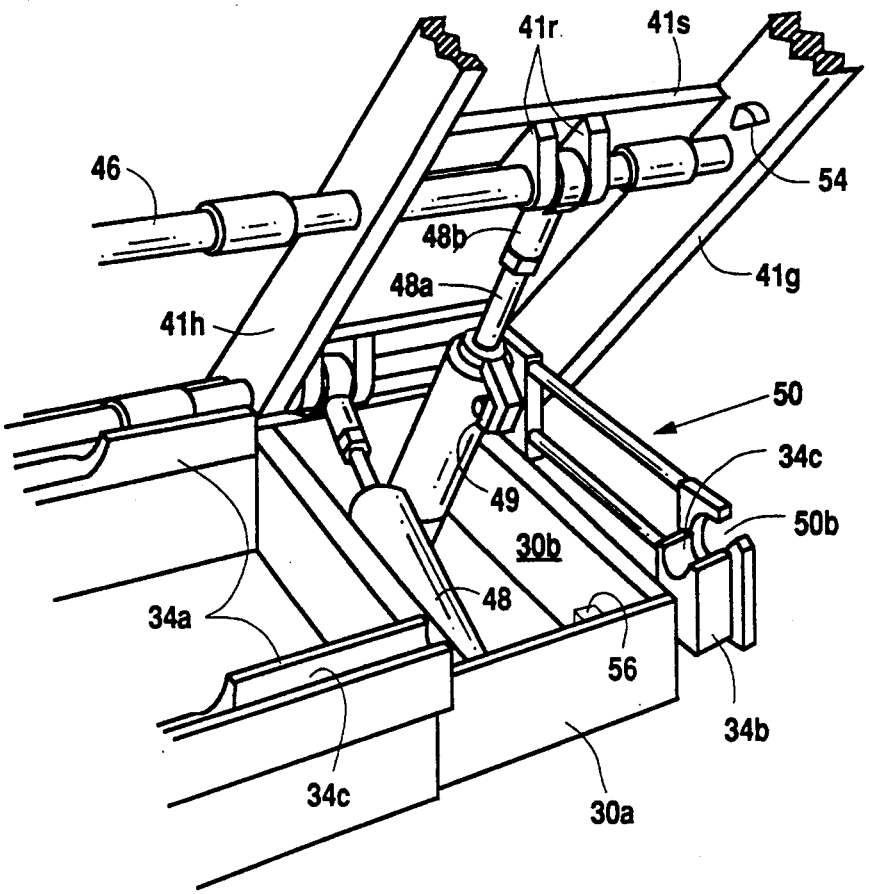
FIG. 4A is a perspective view of the mechanism for tipping the subframe of the bed of FIG. 1 about a selected one of two horizontal, transverse axes.
Figure 7:
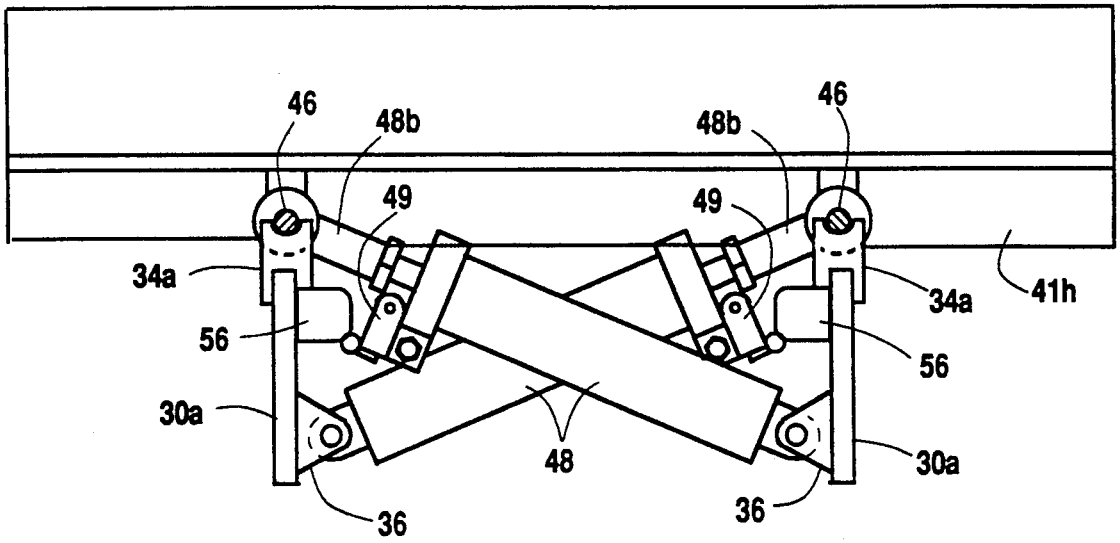
FIG. 7 is a schematic elevational view illustrating a locking mechanism for retaining the tilting cylinders in their collapsed or deenergized position.

Each cylinder 48 is provided with a pivoted latch 49 (FIG. 7) for retaining rod 46 in the respective bearing recess 34*c* when that rod 46 is functioning as the pivot for bed frame 40. The latches 49 are mounted to surround the piston rod 48*a* of the respective cylinder 48 and are pivoted by the movement of a coupling element 48*b* formed on the end of the rod 48*a* (FIG. 4A). Essentially, as a clinder 48 is retracted toward the position pitured in FIG. 6A, element 48*d* forces latch 49 to engage a stationary abutment 56 provided on the internal face of each longitudinal wall 30*a* of subframe 30. That mechanism is such that the latch 49 remains in its locked position (i.e., retaining rod 46 in bearing 46*c*) until element 48*b* again begins to be extended from cylinder 48.

Figure 7A:
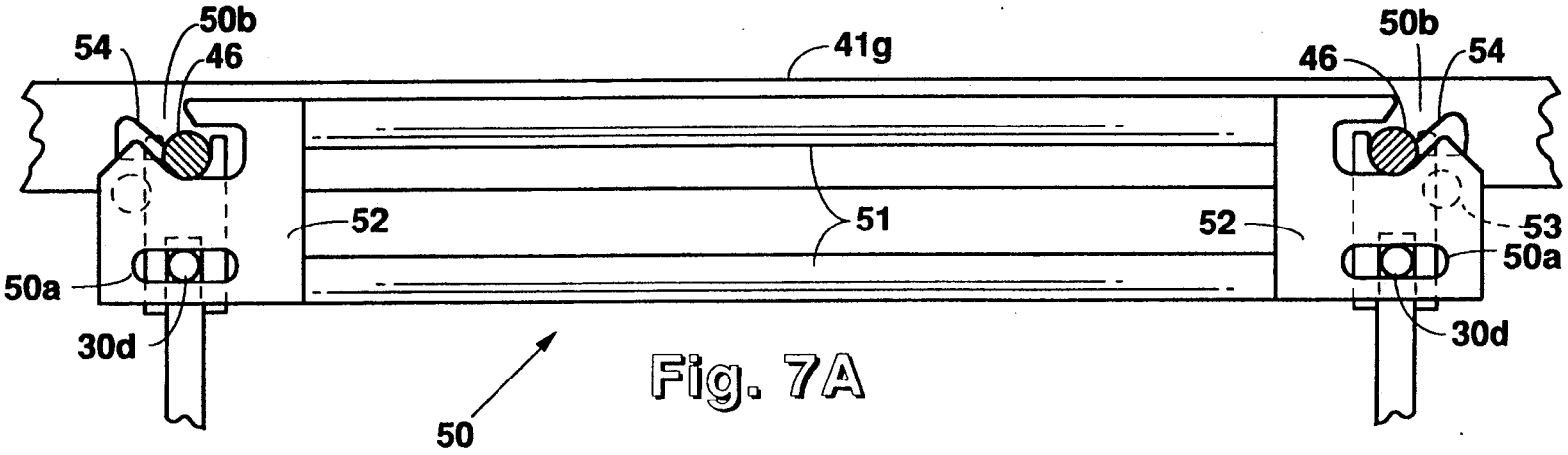
FIG. 7A is an enlarged scale view of a transversely shiftable locking bar for preventing inadvertant removal of pivot rods from their supporting sockets, with the locking bar in a centered position.
Figure 7B:
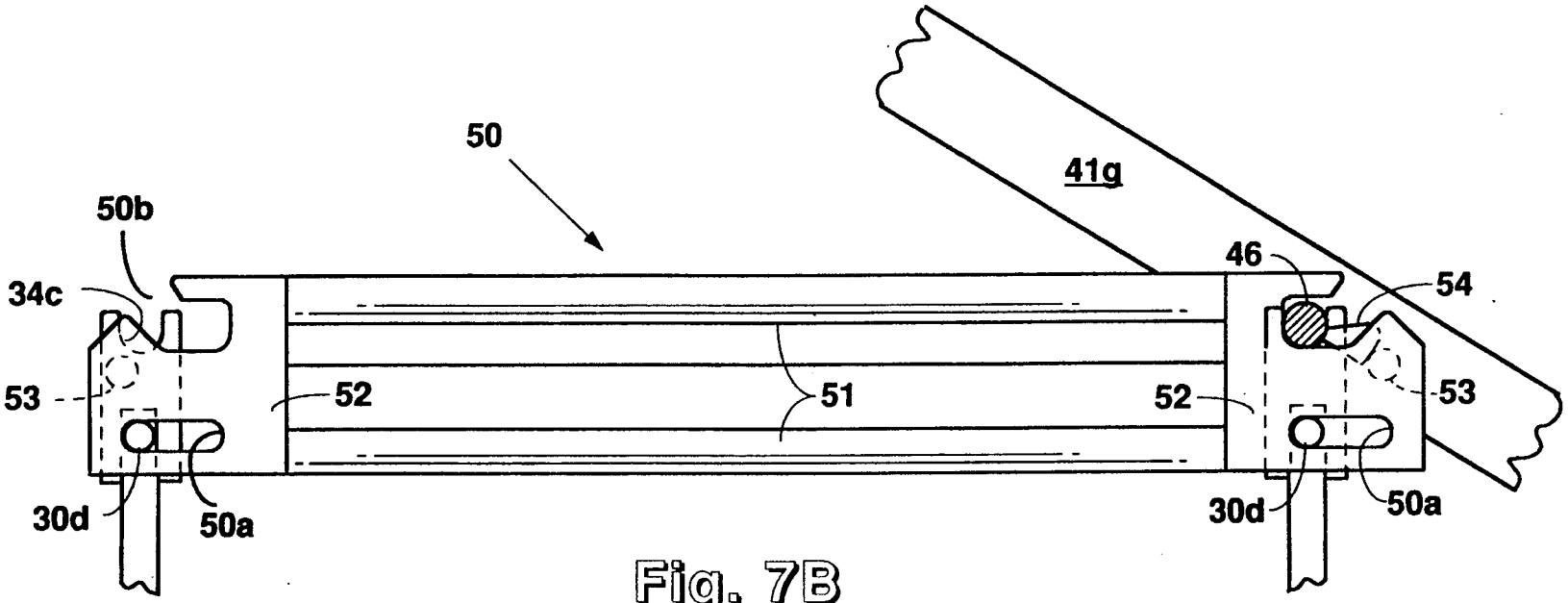
FIG. 7B is a view similar to FIG. 7A but showing the preventing mode of a selected pivot bar in its supporting socket.

To further ensure that the rod 46 acting as the pivot is not displaced from bearing recesses 34*c*, a shiftable latching element 50 (FIGS. 7A and 7B) is also provided. Latching element 50 (also referred to as "safety latch" 50) comprises identical end plates 52 interconnected by bars 51. Plates 52 are mounted on subframe 30 adjacent end wall 30*b* (FIG. 4) by pins 30*d* projecting from side plates 30*a* and respectively traversing slots 50*a* in latching element 50. Each end of latching element 50 defines an upwardly open slot 50*b* contoured to engage the adjacent pivot rod 46 when such rod is engaged in the respective row of bearing sockets 34*c*. Safety mechanism 50 is laterally shiftable such that its opposite ends shift between a latched and an unlatched position relative to the pivot rod 46 engaged at that end. Hence, safety mechanism 50 shifts between keeping one rod 46 retained to keeping the opposite rod 46 retained. The safety mechanism is also such that it cannot concurrently block the entry of both pivot rods into the bearing sockets 34*c*.

When bed frame 40 is horizontal, though, one or the other of rods 46 can be raised by cylinders 48—but not both simultaneously. The lateral movement of the safety mechanism 50 to allow upward movement of one rod 46 and not the other is produced by the initial upward movement of the respective pivot rod 46. As it is raised by pressurization of its respective cylinder 48, it cams the safety latching mechanism 50 laterally on one end to cause the slot 50*b* on the other end to encompass the stationary pivot rod 46. Concurrently, such initial pivotal movement of bed frame 41 will bring a rigid abutment 54 mounted on the adjacent transverse frame element 41*g* of the perimetrical frame 41 downwardly into engagement between the mouth of notch 50*b* and a pin 53 on plate 52 of safety latch 50, thus keeping the stationary rod 46 in the open top socket 34c of the bearing bracket 34b.

Identical (but opposite) action occurs if the other cylinder 48 is energized to put the patient support table 40 in the opposite angular position. Again, the pivot rod 46 which functions as a pivot for this movement, is engaged by another abutment 54 on transverse frame element 41g to keep the stationary rod 46 retained in its pivot position.

Thus, it is readily apparent that the patient support table 40 cannot be removed from the supporting subframe 30 in any of its tilted positions. When, however, the patient support table 40 is in its horizontal position, it is not possible to elevate the patient support table 40 with respect to the subframe 30 because the safety bar 50 is disposed to keep both rods 46 in its notches 50b.

Therapeutic bed 1 is best utilized for a patient who must be immobile for an extended period to accomplish the desired treatment. Patient immobility is accomplished in accordance with this invention by a plurality of adjustably mounted restraining pads which are moved into snug contact with the patients inner legs, outer legs, thoracic region, outer arms, shoulders, and head. If desired, foot supporting plates are provided for each foot. All of these restraints must be adjustable to accommodate various sizes of patients.

In accordance with this invention, all of the aforementioned restraints are mounted to the side or end portions of the support table and the patient supporting surface is not slotted or provided with a plurality of mounting brackets for the various restraint pads. Conventional mattress pads 5 may therefore be used on top surface 40a.

Figure 9:
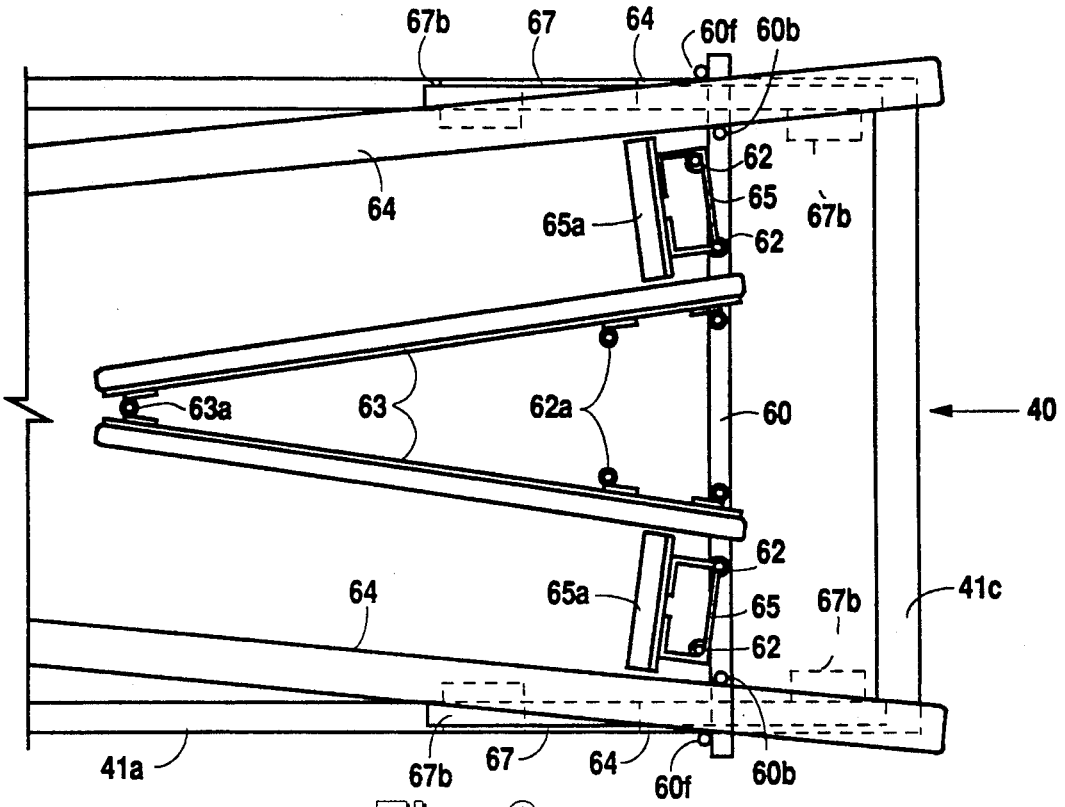
FIG. 9 is a plan view of the mechanism employed for adjustably mounting the leg restraints and foot supports in overlying relation to the patient support table.
Figure 9A:
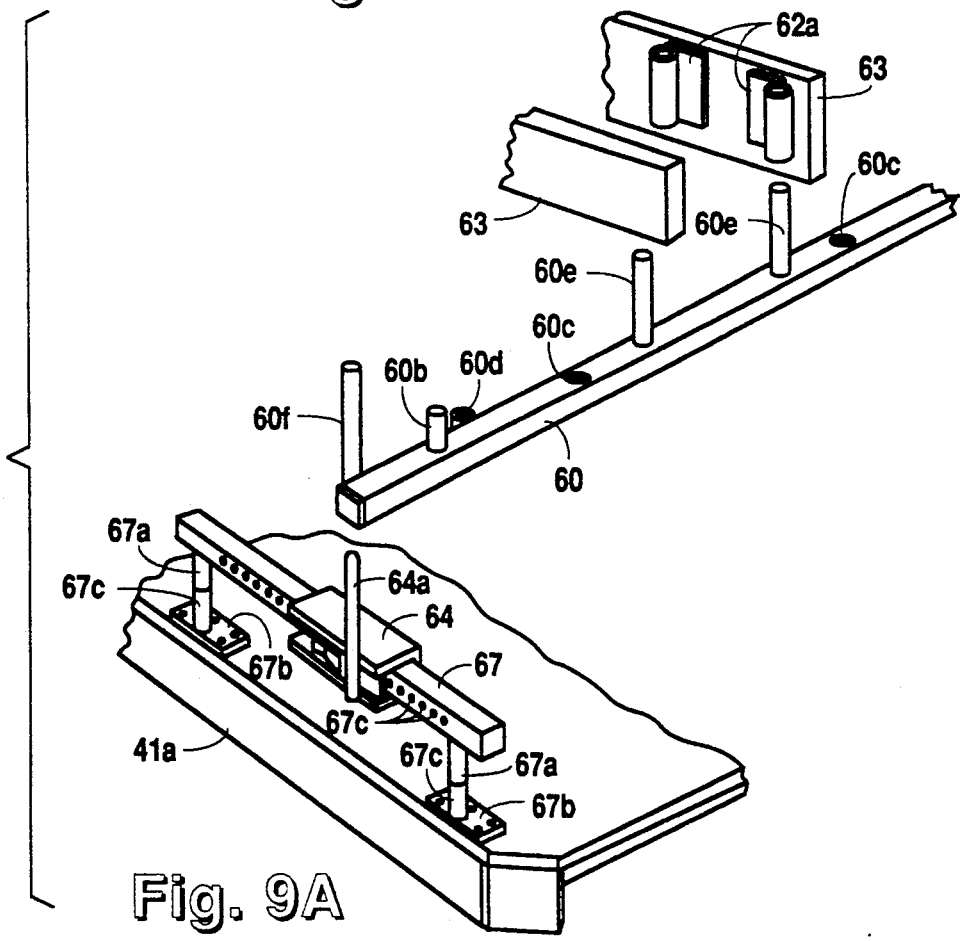
FIG. 9A is an exploded perspective view of the mechanism of FIG. 9.

Thus, referring to FIGS. 9 and 9A, a transverse support bar 60 for the bottom ends of the inner and outer leg restraints 63 and 64 and a foot pad frame 65 is provided. Each end of bar 60 has a vertical support tube 60f secured thereto which slips over an upstanding pin 64a secured to an adjustable bracket 64, which in turn is mounted on an elongated bar 67. Bar 67 is mounted on posts 67a having ends insertable in tubes 67c secured to brackets 67b to the longitudinal frame members 41a respectively.

Bracket 64 incorporates a conventional manually releasable spring pressed pin (not shown) which cooperates with a selected one of a plurality of holes 67c formed in the outer surf ace of the patient height adjusting elongated bar 67.

To mount the outer leg frame 64, the support frame 60 is provided with an upstanding pin 60b which cooperates with vertical tube 60f to clamp the outside leg support structure 64 therebetween.

To mount the frame structure 65 for the foot pad 65a, a vertical hole 60c is provided in support bar 60 together with a bracket defining a vertical bore 60d. The holes 60c and 60d respectively receive pins 62 which mount the respective foot pad frame 65.

Nearer to the center of the support bar 60 two laterally spaced pins 60e (FIG. 9) are provided to receive two brackets 62a formed on the inner sides of the inner leg restraints 63. To provide adjustment of the inner leg restraints 63 relative to the outer leg restraints 64, two additional brackets 62a are provided in longitudinally spaced relationship to the first mentioned pair of brackets 62a. The upper ends of inner leg restraints 63 are connected by a hinge 63a.

Thus, longitudinal adjustment of the inner leg supports and the foot supports may be conveniently accomplished to restrain a patient's legs, whether the patient be large or small, or long legged or short legged.

The upper ends of the outer leg restraint pads are respectively mounted on upstanding pins 71 (FIGS. 8 and 8B) provided on the adjustable frame structure 70 for the pads 73 respectively engaging the thoracic regions of the patient. This structure comprises an L-shaped pad mounting frame 70a having a horizontal flange 70b pivoted to a parallelogram linkage 72 which is pivotally mounted on a bracket 74 slidably secured to a square outer tube 75, by a conventional manually releasable friction latch 74a (FIG. 8A). Outer tube 75 slides on an inner tube 76 secured to the respective longitudinal Hinges 77. Such mounting of the thoracic support structure permits the entire structure to be pivoted about its respective longitudinal hinge axis and removed to a position underlying the patient support table 40 to facilitate access to the patient. The structure 70 is completely detachable from support table 40 in order to enable both placement and removal of a patient from bed 1.

The hinges 77 have depending pins 78 engagable with holes in the respective outer longitudinal frame element 41a of bed frame 41, hence the thoracic frame 70 may be conveniently removed from the bed 1.

The lateral spacing of thoracic pad 73 is adjusted by a link 79 pivotally connected between one of parallelogram links 72 and a conventional manually actuated friction latch 74a (FIG. 8A) slidably mounted on outer square tube 75. Thus the spacing of pad 73 relative to the axis of hinges 77 may be varied.

Figure 8:
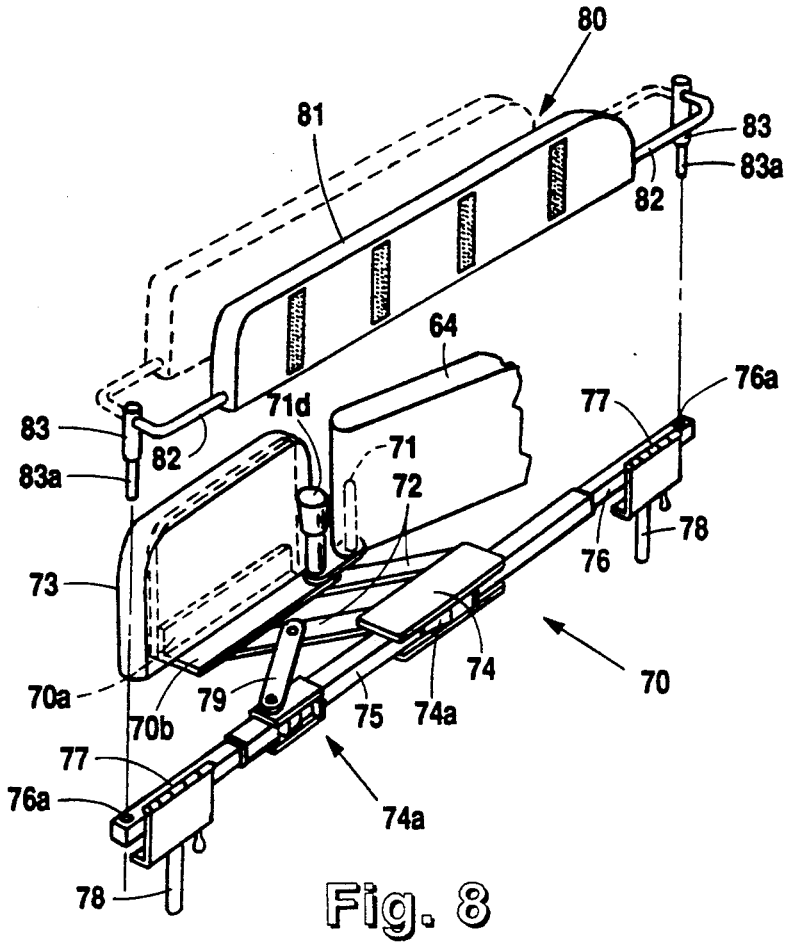
FIG. 8 is an exploded perspective view of the mechanism employed to adjustably mount the thoracic and side arm restraints in overlying relation to the patient support table.
Figure 8A:
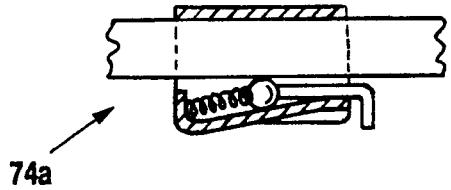
FIG. 8A is an enlarged scale sectional view of a conventional manually releasable friction latch to prevent sliding movement of a bracket on a support element.
Figure 8B:
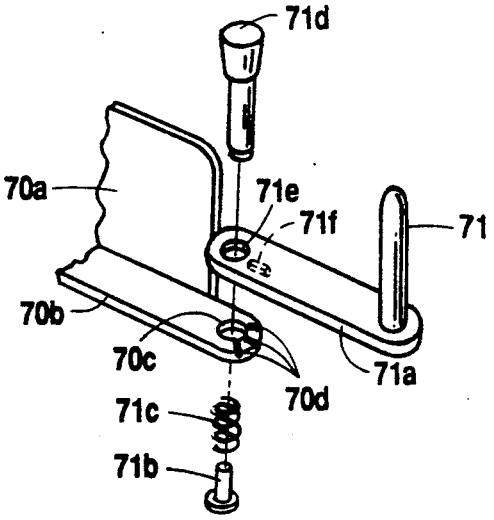
FIG. 8B is an enlarged scale, plan view with parts omitted for clarity, of the manually releasable pivot lock.

Referring to FIG. 8B, the upstanding pin 71 that supports the top end of the respective outer leg support 64 is rigidly secured to a link 71a which is horizontally pivotally adjustable relative to the bed surface by a manually operable pivot latch comprising a hole 70c in the horizontal flange 70b of the mounting plate 70a of the thoracic pad 70. Surrounding hole 70c are peripherally spaced indentations 70d which are selectively engaged by a depending lug 71f on link 71a. A handle 71d projects inwardly into link pivot hole 71e and urges link 71 downwardly by a spring 71c surrounding a bolt 71b which is threadably engaged with handle 71d. Thus, by pulling upwardly on handle 71d the lateral position of the upper ends of the outer leg supports 64 relative to the patient may be conveniently adjusted.

Thoracic frame 70 also provides a mounting for a respective outer arm restraint 80 (FIG. 8). Restraint 80 comprises a pad 81 which has right angle rods 82 projecting horizontally out of each end of pad 81. The outer end of each rod 82 is radially secured to a vertical rod 83. Rod 83 has a reduced diameter lower end portion snugly insertable in a vertical hole 76a provided in the end of inner tube 76. Thus outer arm pads 80 will be readily removable, or may be pivoted with thoracic pads 73 to a position underlying the table frame 41.

The right angle arms 82 permit the mounting of outer arm restraints 80 in either of two lateral positions relative to the bed, as indicated by the dotted lines in FIG. 8.

Figure 10:
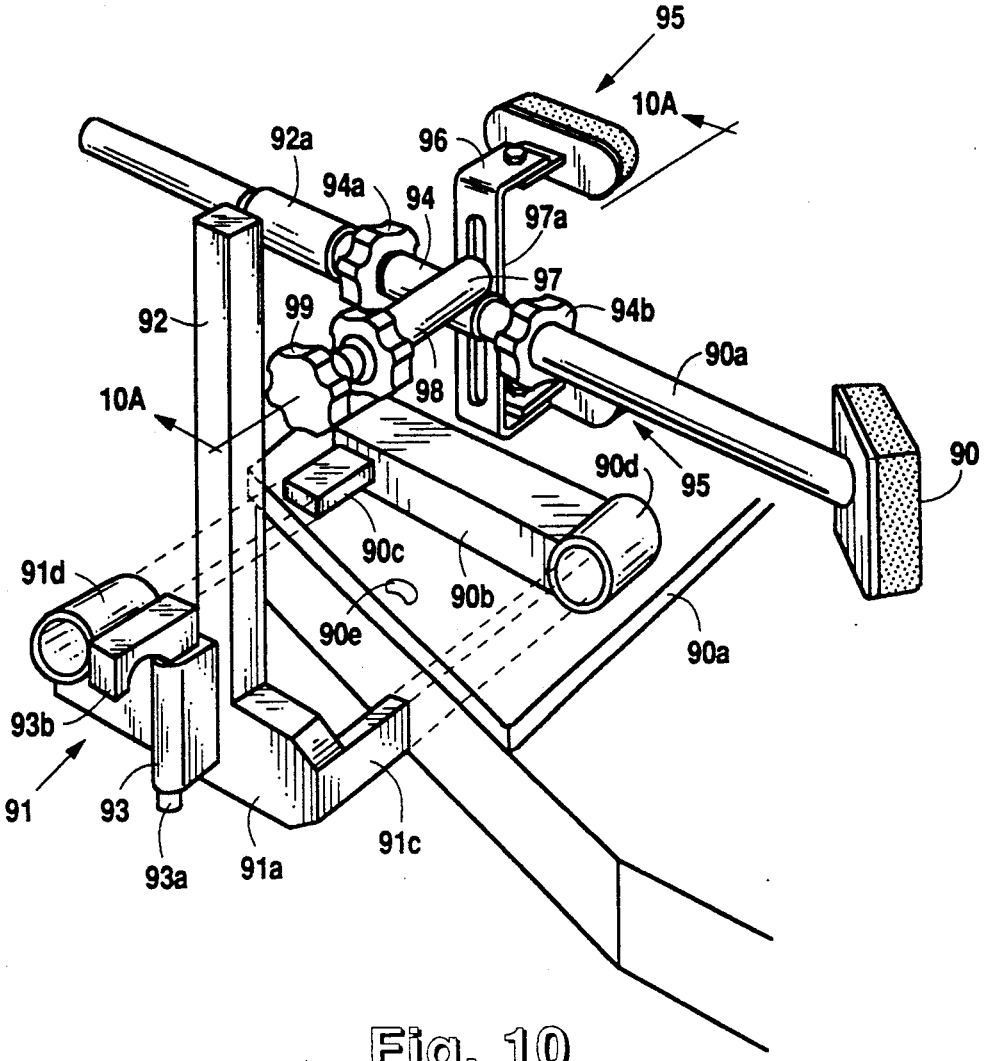
FIG. 10 is an exploded perspective view of the mechanism employed for adjustably mounting the shoulder and head restraints in overlying relation to the patient support table.

Shoulder restraints 90 and the head restraints 95 (FIG. 10) are mounted on a common basic framework. Such framework comprises a plate 90a which is rigidly secured to the head end of the bed frame 41 (FIG. 2) and a mounting bracket 90b is rigidly secured to plate 90a. Mounting bracket 90b comprises a horizontal bar having at one end an outwardly projecting rectangular bar 90c and at the other end a transverse tubular bracket 90d. A support frame for both the shoulder restraint 90 and the head restraints 95 comprises a base bracket 91 having a forwardly projecting rectangular bracket 91a similar to the bracket 90b, and having an inwardly projecting bar 91c and a transverse tubular bracket 91d similar to the bar 90c and tubular bracket 90a, except that the positions of these elements are reversed so that the rectangular bar 90c fits into the tubular bracket 91d and the projecting bar 91c fits into the tubular bracket 91a.

As explained more specifically above, the bar 91a interconnects the projection 91c and the tubular bracket 91d and also mounts an upstanding post 92. A latching bracket 93 is rigidly secured to the bar 91a and provides a manually releasable spring pressed latching plunger 93a which engages a hole 90e provided in the plate 90a when the aforedescribed brackets and bars are interconnected. Handle 93b releases the pin 93a by an upward pull.

On the top of post 92, a horizontal tubular support 92a is rigidly secured. A handle 94a is threadably secured to the outer end of tube 92a and moves a compressible washer lock (not shown) into and out of engagement with tube 90a, thereby permitting longitudinal adjustment of the shoulder restraining pads 90.

The intermediate hollow tube 94 is secured to the tube of the plate 90a by a handle 94b which is also threadably secured to the outer end of tube 94 and moves also a compressible washer lock (not shown) into and out of engagement with tube 90a thereby permitting longitudinal adjustment of the head supports 95.

Figure 10A:
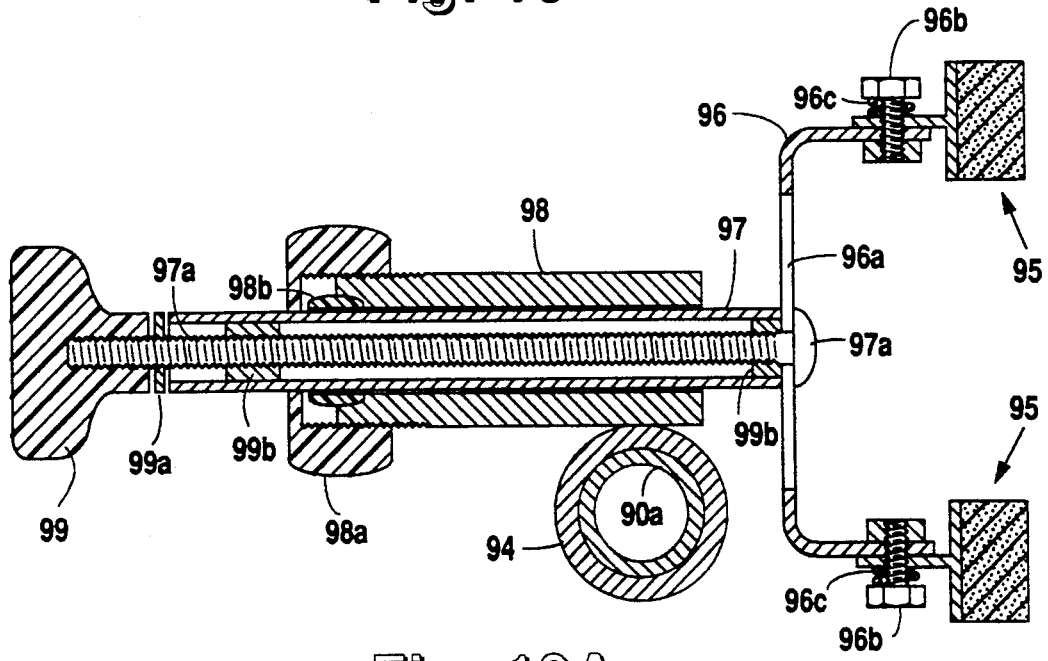
FIG. 10A is a partial sectional view taken on the plane A—A of FIG. 10.

The head supports 95 (FIG. 10A) are respectively flexibly mounted on the arms of a vertically disposed U-shaped bracket 96 by bolts 96b and springs 96c. Bracket 96 is vertically adjustably mounted by an elongated bolt 97a traversing a vertical slot 96a in the U-shaped bracket 96 and threadably secured within a transverse support tube 97. Such securement is accomplished by an internally threaded knob 99 which abuts the other end of tube 97. Appropriate washer 99a and spacer sleeves 99b surround bolt 97a.

The support tube 97 is axially adjustably mounted within the bore of an outer tube 98 which is welded in transverse relation to intermediate tube 94. A handle 98a is threadably secured to the outer end of tube 98 and moves a compressible washer lock 98b into and out of engagement with support tube 97, thereby permitting lateral adjustment of head supports 95 relative to the patient lying on bed 1.

Thus both the lateral, longitudinal and height of head supports 95 relative to the bed frame 41 are readily adjustable, as are the longitudinal positions of the shoulder restraining pads 90.

It sometimes happens that surgery must be performed on the head of the patient while confined in a required position on the support table. To facilitate such surgery, an auxiliary head support 100 is mounted in underlying relationship to the head end of the patient support table frame 41. (FIG. 11) Such head support is provided with two longitudinal side frames 101 which respectively slidably engage rails or recesses 102a defined by two hollow members 41f welded to the juncture of end frame 41b with angle frames 41d. Side frames 101 are secured to an end frame 103 and a rigid plastic cover 104 is suitably secured to the top surfaces of side frames 101. Outward movement of auxiliary head support 100 is limited by bolts 105 which respectively traverse the slots 101a and engage side rails 101.

Thus, the auxiliary head support may be normally positioned underneath the patient support table 40 and then pulled outwardly to provide space for the head of the patient to rest upon, and, more importantly, to provide more convenient access of the surgeon to the patient's head, neck and chest.

Figure 11:
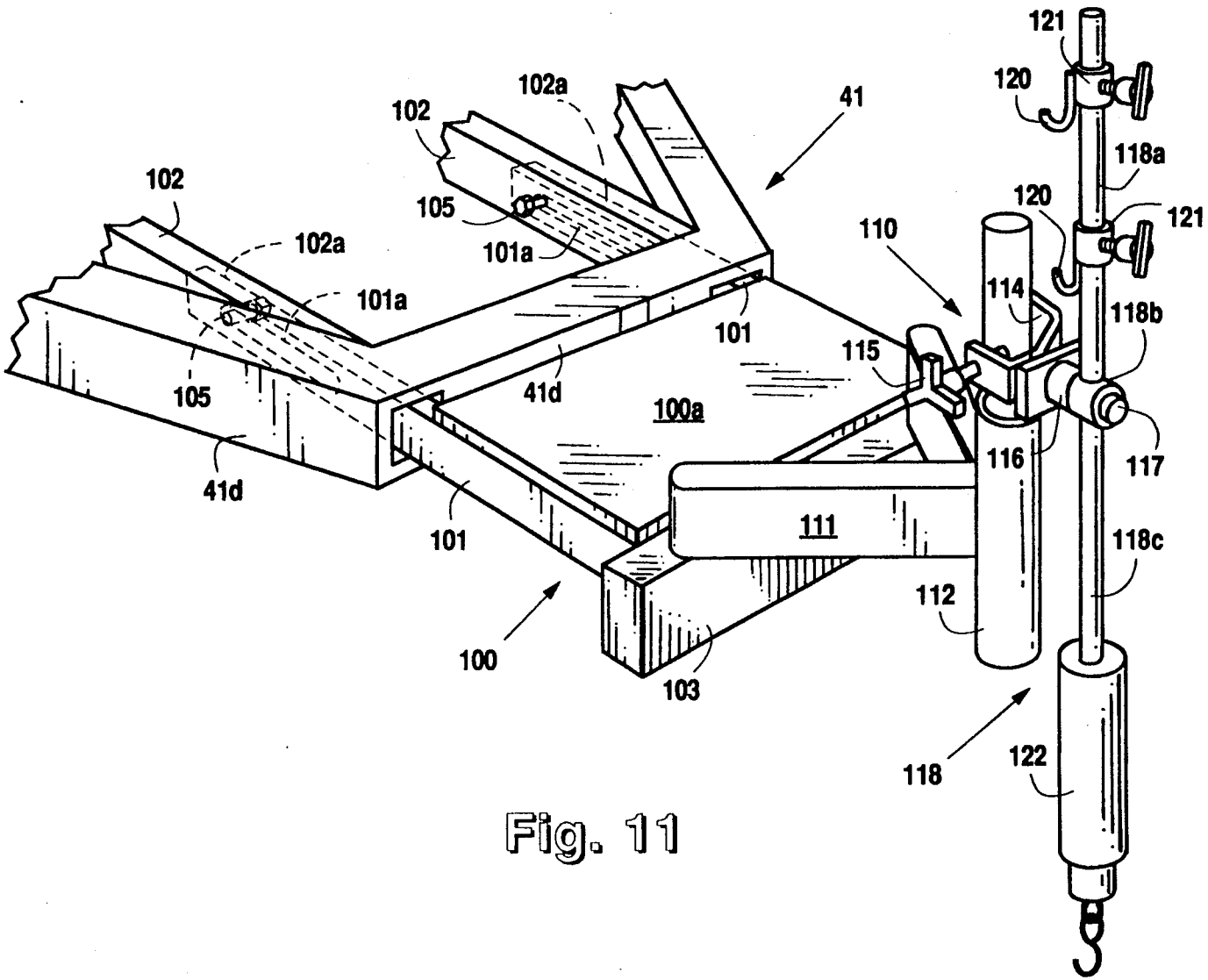
FIG. 11 is an exploded perspective view illustrating the mounting of an auxiliary head support and an I.C.P. bag support on the head end of the bed frame.

Another feature of the therapeutic bed 1 embodying this invention lies in the provision of a bag support element which maintains a constant vertical positioning with respect to the patient irrespective of the tilting of the patient support table about the aforedescribed separate transversely spaced longitudinal axis. Referring to FIG. 11, such support structure 110 comprises a V-shaped bracket 111 welded in forwardly projecting relation to the end frame element 103 of the auxiliary head support 100. A vertical tube 112 is secured to the vertex end of the V-shaped bracket 111, and a post 113 is inserted in the bore of the tube 112. A bracket 114 is adjustably secured at a selected vertical position on the post 113 by means of a threaded clamp 115. Bracket 114 defines a forwardly projecting bushing 116 for a pivot bolt 117.

A pendulum rod 119 has an upper portion 118a and a lower portion 118c radially secured to a medial sleeve portion 118b rotatably mounted on the pivot bolt 117. Hooks 120 for medication bags are provided on sleeves 121 which are adjustably positioned on the upper portions 118a of the pendulum rod 118. The lower portion 118b of the pendulum rod 118 mounts a weight element 122 sufficient to maintain the pendulum rod 118 in a vertical position regardless of the downward forces exerted by the medication bag supported on its upper end.

Thus, as the patient support table 40 is pivoted about either of its two longitudinal pivot axes, the pendulum support post will remain in a vertical position and hence the medication bag will be maintained at the same elevation with respect to the head of the patient. This is very important for the treatment of patients by controlling the pressure of the internal fluid in the brain, as in the I.C.P. treatment wherein the fluid must be maintained at a constant pressure during the treatment. Another feature of the V-shaped bracket 111, the vertical tube 112 and the post 113 is to provide the means for cervical traction by inserting a cable (not shown) through the post 113 and the vertical tube 112 to hold the traction weights in a conventional way already known in the prior art.

As a final measure to assure the immobility of the patient, one or more belts 130 (FIG. 2) may be provided to traverse the patients body and the various restraints. Such belts are stored in belt retractors 131 of the automotive type, secured to one longitudinal side frame 41a and their free ends are snapped into belt latches 132 mounted on the other side frame 41a.

The electrical and hydraulic control circuits for the various fluid actuated cylinders are entirely conventional and known to those skilled in the art. If desired, the electrical control panel 125 (FIG. 3) may be located on the foot end of bed frame 41.

From the foregoing description, it will be readily apparent that a therapeutic bed embodying this invention is not only economical to construct and reliable to operate, but provides rotation treatment to prevent complications of immobility. A brief summary of the most common complications of patient immobility are prevention of: tissue degeneration of the skin; pulmonary complications; cardiovascular complications; such as deep vein thrombosis; constipation and fecal impactions; musculoskeletal degeneration; urinary tract infections and kidney and bladder stones.

In summary, a therapeutic bed embodying this invention is advantageously utilized for a patient who is immobilized due to traction, coma, advanced neurological disorders, surgery and/or multiple injuries, particularly if there is concomitant pulmonary congestion, flail chest, pneumonia, or the presence of chest tubes.

Modifications of this invention will be readily apparent to those skilled in the art and it is intended that all such modifications be included within the scope of the appended claims.

What is claimed and desired to be secured by Letters Patent is:

1. A therapeutic bed comprising, in combination:
an elongated base frame structure having floor engaging means formed thereon in horizontally spaced, depending relation;
a generally rectangular patient support table having a length and width exceeding the height and width of a patient's body laying thereon;
a pair of laterally spaced parallel rods secured to the underside of the central portion of said patient support table and extending parallel to the length of said patient support table;
a horizontally elongated subframe;
means for adjusting the height of said subframe relative to said base frame structure;
means for adjusting the vertical angle of said subframe in both directions from the horizontal;
two rows of longitudinally aligned, upwardly open socket means on said subframe respectively engagable with said laterally spaced, parallel rods; and
a pair of fluid pressure actuated means for selectively pivoting said patient support table about one or the other of said parallel rods.

2. The apparatus defined in claim 1 further comprising:
means operable by pressurization of one of said fluid pressure actuated means to restrain the other one of said rods within the respective said socket means, while said support table is pivoted about said other rod.

3. The apparatus defined in claim 1 wherein said fluid pressure actuated means comprises:
a pair of fluid pressure actuated cylinder means having spaced end portions relatively movable by application of fluid pressure to said cylinder means;
one of said cylinder means having its one end portion pivotally encompassing one of said rods and its other end portion pivotally secured to said subframe about a horizontal axis, whereby fluid pressure expansion of said one cylinder means effects the rotation of said patient support table about one of said rods in one direction;
the other of said cylinder means having its one end portion pivotally encompassing the other of said rods and its other end portion pivotally secured to said subframe about a horizontal axis, whereby fluid pressure expansion of said other cylinder means effects the rotation of said patient support table about the other of said rods in an opposite direction.

4. The apparatus of claim 3 further comprising:
a pair of laterally spaced abutments formed on said subframe in positions respectively adjacent said other end portions of said cylinder means when said cylinder means are fully retracted and thereby positioning both said rods in inserted positions in the respective said row of sockets; and
latch means on each said other end portions of said cylinder means for engaging said abutments to prevent movements of said rods out of the respective row of said upwardly open sockets except by fluid pressure expansion of only one of said cylinder means.

5. The apparatus of claim 3 wherein each said cylinder means comprises a cylinder, a cooperating piston and piston rod having an end portion encompassing a respective one of said rods, and further comprising:
a pair of laterally spaced abutments formed on said subframe in positions respectively adjacent said piston rod end portions when said pistons are fully retracted and thereby positioning said support table rods in inserted positions in the respective said row of sockets; and
latch means pivotally mounted on each said piston rod element for engaging the adjacent one of said abutments to prevent movements of said support table rods out of the respective row of said upwardly open sockets except by fluid pressure expansion of only one of said pistons.

6. The apparatus of claim 1 wherein said means for selectively pivoting said support table comprises:
means defining a pair of laterally spaced, pivot bearings on said subframe respectively axially parallel to said rods;
a pair of fluid pressure operated cylinders respectively pivotally mounted between said rods and said laterally spaced pivot bearings on said subframe;
said cylinders being disposed in an X-shaped array, thereby permitting pressurization of one cylinder to pivot said patient support table in one direction about one of said parallel rods, and pressurization of said other cylinder to pivot said patient support table in the opposite direction about the other of said parallel rods.

7. The apparatus defined in claim 1 wherein said patient support table comprises a perimetrical metallic frame structure disposed entirely outside of the boundaries of a patient's body to be supported by said support table, said support table having an upper surface formed of a radio translucent material, whereby radiation may be transmitted through a patient's body and the medial portions of said support table;
said laterally spaced, parallel rods being mounted in said perimetrical metallic frame structure.

8. The apparatus defined in claim 7 further comprising:
an opening in said radiation transmitting medial portion of said support table adjacent the center of said patient support table and located adjacent the inner portions of said perimetrical frame structure;
means defining a support for body waste collecting containers beneath said opening; and
a lid closing said opening, the top surface of said lid being flush with said upper surface of said patient support table and having at least one waste collecting tube opening formed therein.

9. The apparatus defined in claim 1 wherein said patient support table has a patient supporting top surface and further comprising:

a pair of inner leg side restraints positioned on said top surface in upstanding relation and defining a V-shaped configuration having a vertex terminating at the desired location of the patient's crotch;

a pair of outside leg restraints positioned on said top surface in upstanding relation respectively parallel to said inner leg restraints;

a pair of foot supports respectively mounted in upstanding relation to said top surface between each inner leg side restraint and the adjacent parallel outside leg restraint;

a pair of thoracic restraints positioned over said top surface in upstanding, parallel relationship and respectively having lower vertical sides disposed adjacent to the upper ends of said outside leg restraints;

a pair of shoulder engaging restraints positioned over said top surface in upstanding relation and being respectively positioned to engage the shoulders of the patient;

a pair of head engaging restraints positioned over said top surface and being respectively constructed and arranged to engage opposite sides of the patient's head; and a pair of outer arm restraints respectively positioned in upstanding relation to the longitudinal edges of said top surface to respectively trap the patient's arms against the outer surface of the adjacent one of said thoracic supports.

10. The apparatus of claim 9 further comprising means for adjusting the longitudinal and lateral positions of said inner and outer leg restraints relative to said top surface to accommodate different sizes of patients; and means for adjusting the longitudinal position of said inner and outer leg restraints and said foot supports relative to said top surface to accommodate different sizes of patients.

11. The apparatus of claim 9 further comprising means for adjusting the longitudinal and lateral positions of said thoracic restraints relative to said top surface to accommodate different sizes of patients.

12. The apparatus of claim 9 further comprising means for adjusting the longitudinal position of said shoulder engaging restraints relative to said top surface to accommodate different sizes of patients.

13. The apparatus of claim 9 further comprising means for adjusting the longitudinal, lateral and height positions of said head engaging restraints relative to said top surface to accommodate different sizes of patients.

14. The apparatus of claim 9 further comprising means for adjusting the lateral positions of said arm restraints relative to said top surface to accommodate different sizes of patients.

15. The apparatus defined in claim 9 further comprising:

a supporting frame for said thoracic restraints;

means for pivotally mounting said thoracic restraint frames respectively to the longitudinal sides of said patient support table for movement about a longitudinal, horizontal axis between an upstanding operative position and a depending inoperative position to facilitate movement of the patient onto and off of said top surface; and means for adjusting the radial position of each said thoracic restraint relative to the respective said longitudinal, horizontal axis.

16. The apparatus defined in claim 15 further comprising means for mounting said arm restraints respectively on said thoracic restraint frames for pivotal movement therewith.

17. The apparatus defined in claim 1 wherein said patient support table has a top surface and further comprising a head supporting extension of said top surface slidably mountable in the end of said patient support table corresponding to the normal location of the patient's head;

said head supporting extension having a lateral width substantially less than the width of said patient support table, thereby permitting convenient access to the head portions of the patient for surgical treatment.

18. The apparatus of claim 1 further comprising a plurality of strap means secured to the longitudinal sides of said patient support table to traverse the upper body of the patient and secure the patient's body on said patient support table when said patient support table is pivoted to an extreme position about either of said rods.

19. The apparatus defined in claim 1 further comprising:

a latching bar slidably mounted on said subframe adjacent said sockets for transverse movements relative to said sockets;

the end portions of said latching bar respectively defining rod retaining projections constructed and arranged to transversely move into engagement with one, but not both, of said rods when positioned in one of said rows of sockets, thereby preventing upward movement of the engaged rod out of the respective said row of upwardly open sockets; and lock means on said subframe adjacent each of said fluid pressure actuated means for moving into engagement with the said rod functioning as the pivot for said support table when a selected one of said pair of fluid pressure actuated means is actuated.

20. The apparatus defined in claim 1 wherein said patient support table has one end configured to support the head of the patient, and further comprising a projecting bracket formed on said one end of said patient support table and defining a vertical bore;

a rod inserted in said bracket bore in upstanding relation;

means on the upper portion of said upstanding rod defining a horizontal pivot; and a vertical support rod having its medial portion pivotally engaged with said horizontal pivot, a bag support hook mounted on its upper portion, and a weight secured to its bottom portion, whereby said support rod maintains a vertical position irrespective of the pivoted position of said patient support table relative to said rods.

21. A therapeutic bed comprising, in combination:

an elongated base frame structure having floor engaging means formed thereon in horizontally spaced, depending relation;

a generally rectangular patient support table having a length and width exceeding the height and width of a patient's body laying thereon;

a pair of laterally spaced parallel rods secured to the underside of the medial portion of said patient support table and extending parallel to the length of said patient support table;

an elongated cantilever support frame having one end pivotally secured to said base frame for movement in a vertical plane about a transverse horizonal axis located adjacent one end of the base frame;

first fluid pressure actuated means disposed intermediate said base frame and said cantilever support means for adjusting the angular position of said cantilever support frame in a vertical plane relative to said base frame;

a subframe and means for securing said subframe to the other end of said cantilever support frame including means for positioning said subframe in any selected position relative to the horizontal independently of the pivotal position of said cantilever support frame in a vertical plane about said transverse horizontal axis;

a plurality of longitudinally aligned, transversely spaced, upwardly open socket means on said subframe respectively engagable with said laterally spaced rods, whereby the angular position of said cantilever support frame relative to said base frame determines the vertical height of said patient support table; and a pair of second fluid pressure actuated means for selectively pivoting said patient support table about one or the other of said parallel rods.

22. A therapeutic bed comprising, in combination:

an elongated floor engaging base;

at least one actuator for adjusting the height of said subframe relative to said base;

at least a second actuator for adjusting the angular position of said subframe in a first vertical plane relative to said base;

an elongated patient support having a central axis oriented lengthwise, the length dimension of said support being parallel to the length dimension of said base;

a pair of pivots each of said pivots including a socket and a corresponding cylindrical member, the sockets being adapted to releasably receive the corresponding cylindrical members in pivotal relation, the pivotal axes of said pivots extending lengthwise relative to said patient support for pivotally connecting said patient support to said subframe, and each of said pivots being laterally spaced from the central axis of said patient support; and at least a third actuator for selectively and repetitively oscillating said patient support in a second vertical plane about either of said pivots, the second vertical plane being generally perpendicular to the first vertical plane.

23. The apparatus of claim 22 wherein each of said cylinders comprises a rod.

* * * * *